US006279522B1

(12) United States Patent
Balzar et al.

(10) Patent No.: US 6,279,522 B1
(45) Date of Patent: Aug. 28, 2001

(54) DRIVE TRAIN FOR OVERHEAD CAM ENGINE

(75) Inventors: Rodney J. Balzar, Neenah; Thomas A. Immel, Malone; Gar M. Adams, Chilton; Kyle I. Kubista, Sheboygan, all of WI (US)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 09/528,109

(22) Filed: Mar. 17, 2000

Related U.S. Application Data

(60) Provisional application No. 60/125,143, filed on Mar. 19, 1999.

(51) Int. Cl.[7] ..... F01L 1/00

(52) U.S. Cl. ..... 123/90.1

(58) Field of Search ..... 123/90.1, 90.11, 123/90.24, 90.39, 90.25, 90.26, 90.27, 90.41, 90.42, 90.44

(56) References Cited

U.S. PATENT DOCUMENTS

| | | | | |
|---|---|---|---|---|
| 951,965 | | 3/1910 | Potter . | |
| 1,087,803 | | 2/1914 | Melling . | |
| 1,147,313 | | 7/1915 | Desort . | |
| 1,239,933 | | 9/1917 | Miller et al. . | |
| 1,542,617 | | 6/1925 | Guy et al. . | |
| 2,218,332 | | 10/1940 | Fowler . | |
| 2,980,089 | | 4/1961 | Sampoetro . | |
| 3,045,657 | | 7/1962 | Sampoetro . | |
| 4,430,969 | * | 2/1984 | Holtzberg et al. | 123/90.11 |
| 4,502,427 | | 3/1985 | Brille . | |
| 4,513,702 | | 4/1985 | Koga et al. . | |
| 4,697,555 | | 10/1987 | Fujikawa et al. . | |
| 4,711,202 | | 12/1987 | Baker . | |
| 4,722,306 | | 2/1988 | Fujikawa et al. . | |
| 4,736,717 | | 4/1988 | Fujikawa et al. . | |
| 4,930,469 | | 6/1990 | Kamprath et al. . | |
| 4,977,868 | | 12/1990 | Holschuh . | |
| 5,007,307 | | 4/1991 | Tamazawa et al. . | |
| 5,031,591 | | 7/1991 | Shinoda et al. . | |
| 5,040,500 | | 8/1991 | Reece . | |
| 5,058,540 | | 10/1991 | Matsumoto . | |
| 5,090,375 | * | 2/1992 | Hudson | 123/196 W |
| 5,143,033 | | 9/1992 | Catterson et al. . | |
| 5,213,074 | | 5/1993 | Imagawa et al. . | |
| 5,267,536 | | 12/1993 | Imagawa et al. . | |
| 5,293,847 | | 3/1994 | Hoffman et al. . | |
| 5,357,917 | | 10/1994 | Everts . | |
| 5,447,127 | | 9/1995 | Luck et al. . | |
| 5,501,186 | | 3/1996 | Hara et al. . | |
| 5,513,606 | | 5/1996 | Shibata . | |
| 5,588,408 | | 12/1996 | Kurihara . | |
| 5,606,943 | | 3/1997 | Tamba et al. . | |
| 5,615,586 | | 4/1997 | Phillips et al. . | |
| 5,706,769 | | 1/1998 | Shimizu . | |
| 5,743,228 | * | 4/1998 | Takahashi | 12/195 P |

FOREIGN PATENT DOCUMENTS

| | | | |
|---|---|---|---|
| 1039099 A1 | * | 9/2000 | (EP) . |
| 1043481 A1 | * | 10/2000 | (EP) . |
| 54-27615 | | 3/1979 | (JP) . |

* cited by examiner

*Primary Examiner*—Teresa Walberg
*Assistant Examiner*—Vinod D Patel
(74) *Attorney, Agent, or Firm*—Baker & Daniels

(57) ABSTRACT

A drive train for a four stroke, overhead cam engine is provided, comprising a crankshaft, connecting rod, and piston assembly for reciprocating the piston within the cylinder bore of a cylinder block. An internally profiled cam gear is driven around an axis perpendicular to the axis of the cylinder block. A pair of follower arms extend from a pair of rocker arms and engage the cam profile to actuate intake and exhaust valves in the cylinder block. An intermediate gear is driven by the crankshaft at half speed to drive the cam gear, and may also be used to drive an additional device, such as a combination oil pump and governor. The cam follower arms may be disposed in an overlapping crosswise arrangement generally parallel to the cam gear, or may be disposed perpendicular to the cam gear.

20 Claims, 10 Drawing Sheets

DRIVE TRAIN FOR OVERHEAD CAM ENGINE

CROSS REFERENCE TO RELATED APPLICATIONS

This application claims the benefit under Title 35, U.S.C. § 119(e) of U.S. Provisional Patent Application Ser. No. 60/125,143, entitled DRIVE TRAIN FOR OVERHEAD CAM ENGINE, filed on Mar. 19, 1999.

BACKGROUND OF THE INVENTION

1. Field of the Invention

The field of the present invention relates to overhead valve engines, such as overhead cam engines, for use in a variety of applications, such as walk behind lawnmowers, lawn and garden implements, or in small utility vehicles such as riding lawnmowers, lawn tractors, and the like. In particular, the invention relates a drive train for such engines in which the crankshaft drives an internally profiled cam gear which in turn actuates a pair of rocker arms having cam followers in engagement with the cam profile to open and close intake and exhaust valves in the cylinder head.

2. Description of the Related Art

Prior known engines containing drive trains of an overhead valve design are well known in the art. For example, in one known arrangement, a crankshaft drives a camshaft located near the crankcase through a gear set. The camshaft includes one or more lobes which actuate a pair of cam followers mounted for rotation on a cam follower shaft. The cam followers in turn actuate push rods extending from the crankcase to the cylinder head, and the push rods rotate a pair of rocker arms mounted in the cylinder head to open and close the intake and exhaust valves.

In another known arrangement, a camshaft located in the cylinder head is driven from the crankshaft by means of a belt, chain, or the like. The camshaft includes one or more lobes that actuate the intake and exhaust valves either directly, or through a pair of rocker arms rotatably mounted in the cylinder head.

A disadvantage with the first arrangement is that the several components of the drive train, including the camshaft, camshaft lobes, cam follower shaft, cam followers, push rods, and rocker arms tends to increase the overall size of the engine. The multiple components also increase the cost and complexity of the engine, the difficulty of assembly, and the likelihood of failure of one of the components.

A disadvantage of the second arrangement is that locating the camshaft in the cylinder head increases the width of the cylinder head due to the lateral space between cam lobes and/or between a cam lobe and the pulley or sprocket which is mounted on the camshaft and driven from the crankshaft. The location of the camshaft directly above the valves, when the camshaft actuates the valves directly, also increases the length of the cylinder head. In addition, the length of the cylinder head is further increased to accommodate the relatively large pulley or sprocket mounted on the camshaft which is necessary for speed reduction. Further, the belt, chain or the like which drives the camshaft from the crankshaft is prone to wearing or breakage.

What is needed is a drive train for an engine which is compact, such that the drive train may allow a smaller engine height and width.

A further need is for a drive train for an engine where the drive train is simplified and includes a minimum of components.

SUMMARY OF THE INVENTION

The present invention provides a drive train for an overhead cam engine, including a cam gear driven by the crankshaft through drive linkage, the cam gear having an internal cam profile surface, and a pair of cam followers extending from a pair of rocker arms mounted in the cylinder head, which engage the cam profile surface and actuate the rocker arms to open and close the intake and exhaust valves.

The internally profiled cam gear is mounted on a camshaft located in the side of the cylinder head, rather than axially above the cylinder bore as in previous arrangements, such that the cam gear is shifted toward the crankshaft and mounted in the side of the cylinder head closely adjacent the rocker arms and valves. The internally profiled cam gear is driven by the crankshaft at half speed through drive linkage, such as an intermediate gear driven by a drive gear mounted on the crankshaft. The intermediate gear and cam gear are located in a gear pocket integral with the cylinder block.

In one embodiment, the cam follower arms are rigidly connected to the rocker arms, and extend perpendicular to the cam gear and terminate in rollers which engage the internal cam profile of the cam gear.

Alternatively, in another embodiment, the rocker arms include cam follower arms that overlap each other in a crosswise arrangement and terminate in ends which each engage the internal cam profile of the cam gear.

In one form thereof, an overhead cam engine is provided, including a crankshaft, connecting rod, and piston assembly, the piston reciprocating within a cylinder block adjacent the cylinder head. A cam gear is driven by the crankshaft and rotatably supported in the cylinder head, the cam gear having gear teeth around an outer periphery thereof, and a cam profile surface disposed around an inner periphery thereof. Drive linkage is disposed between the crankshaft and the cam gear, and a pair of rocker arms are rotatably mounted in a cylinder block for actuating a pair of valves, each rocker arm including a cam follower in engagement with the cam profile surface.

An advantage of this arrangement is that it allows the size of the engine to be minimized. First, the cam gear is mounted laterally in the side of the cylinder head closely adjacent the rocker arms and valves. Also, the internal cam profile of the cam gear obviates the need for an external lobe mounted on the camshaft which would necessitate a larger cylinder head. Additionally, the cam follower arms engage the internal cam profile near an outer edge of the cam gear such that the outer edge of the cam gear does not extend substantially past the top of the valve stems, which further conserves space in the cylinder head.

A further advantage is that the diameter of the intermediate gear may be varied, and the intermediate gear may be disposed in a lateral offset relationship with the drive gear and the cam gear to accommodate differing shapes and sizes of engine housings. Also, the intermediate gear may be used to drive an auxiliary device such as a combination oil pump and governor, for example.

A further advantage is that the intake and exhaust valves are oriented in a plane parallel to the piston axis, such that cooling air from the flywheel is directed by the blower housing into contact with the cylinder head equally around the intake and exhaust valves. Additionally, air passages extending through the cylinder head above the intake and exhaust ports allow cooling air to flow through the cylinder head.

A further advantage is that oil pumped to the cylinder head may drain under gravity back into the oil sump through the gear pocket, and therefore does not need to be pumped back to the oil sump.

A still further advantage is that the drive train includes a simple gear set having a minimal number of durable components.

BRIEF DESCRIPTION OF THE DRAWINGS

The above-mentioned and other features and advantages of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION

Figure 1:
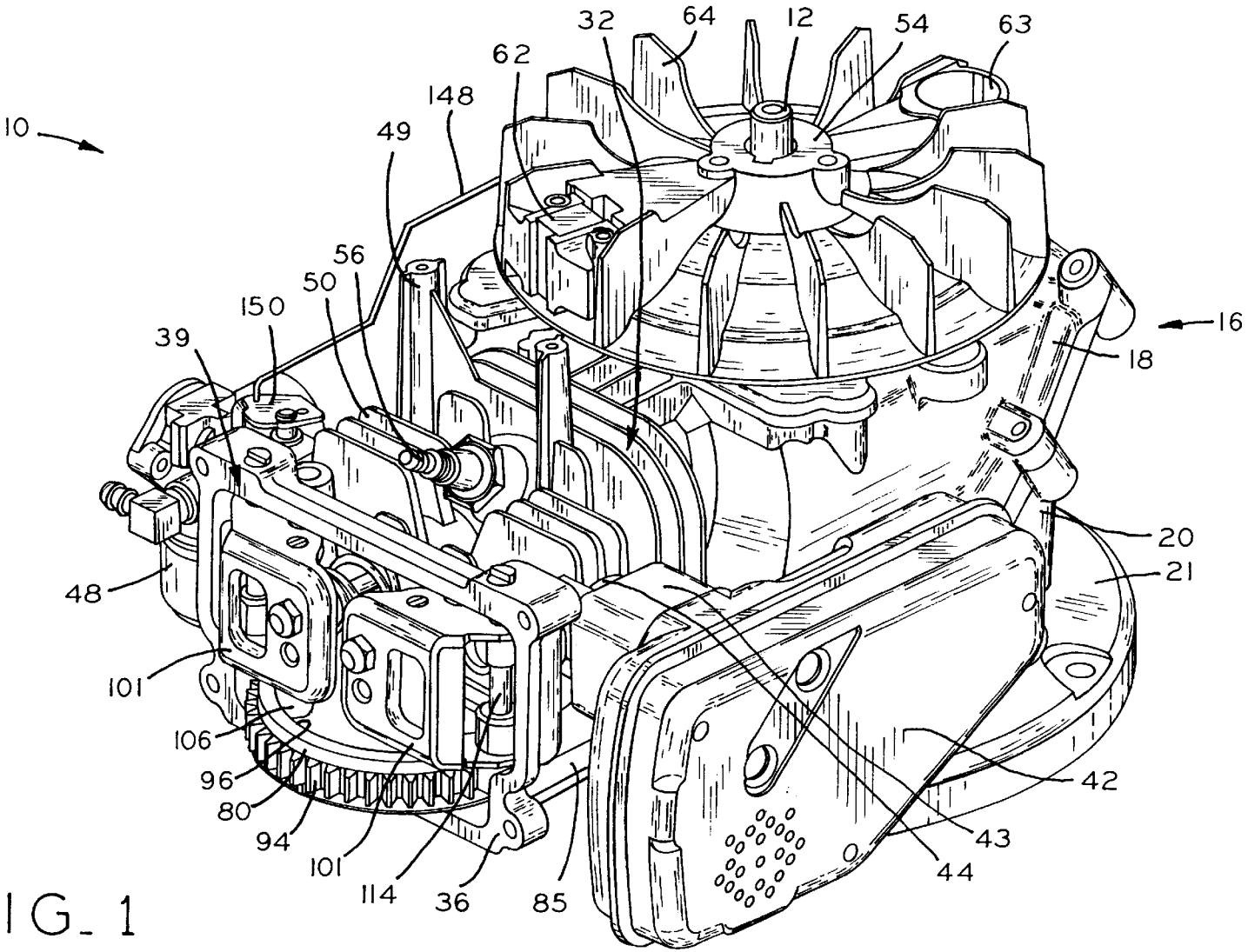
FIG. 1 is an isometric view of an overhead cam engine, showing the flywheel, muffler, carburetor, and part of the drive train in accordance with the present invention.
Figure 2:
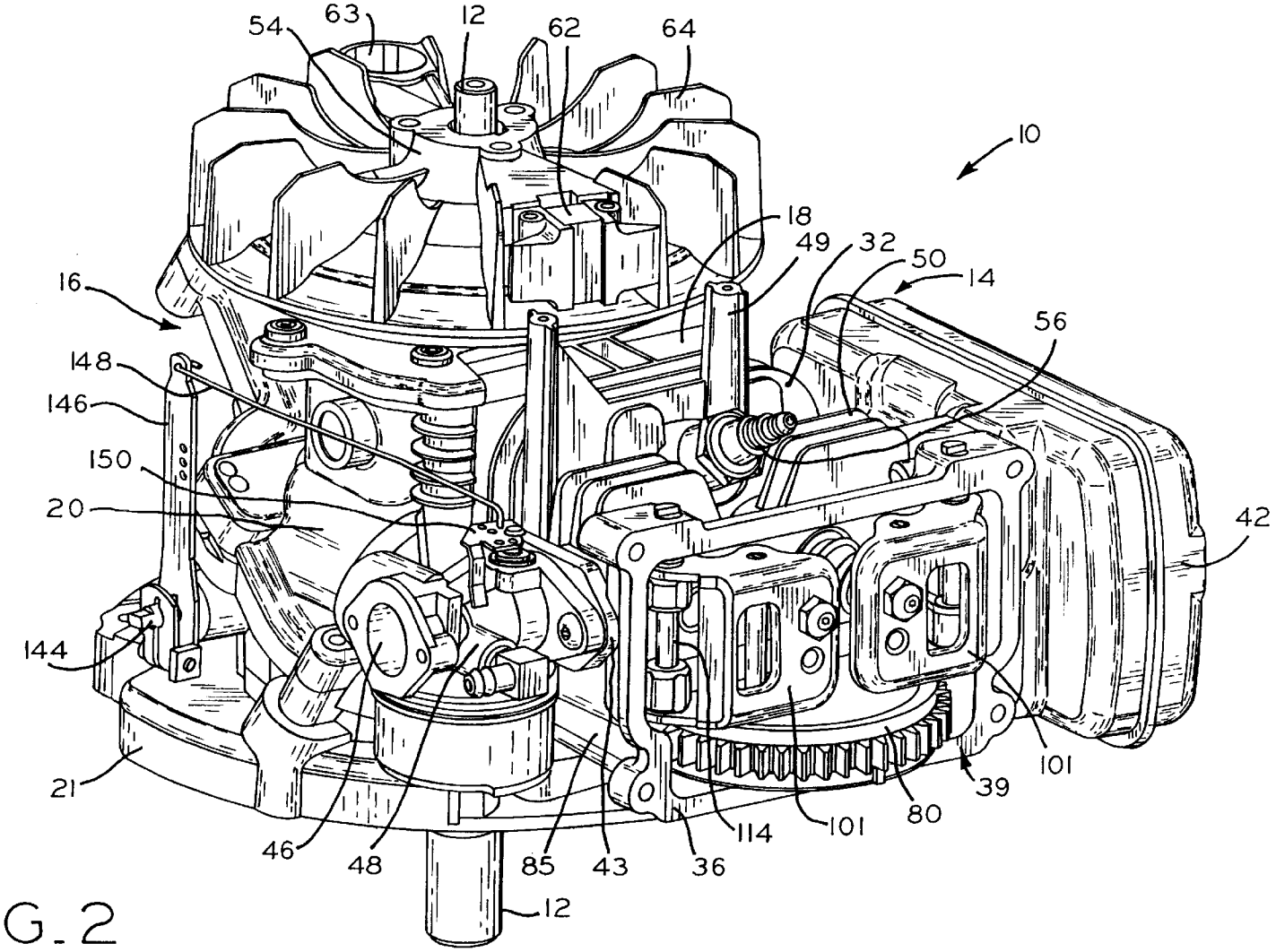
FIG. 2 is an isometric view of the overhead cam engine of FIG. 1, showing the flywheel, muffler, carburetor, governor linkage, and part of the drive train.
Figure 3:
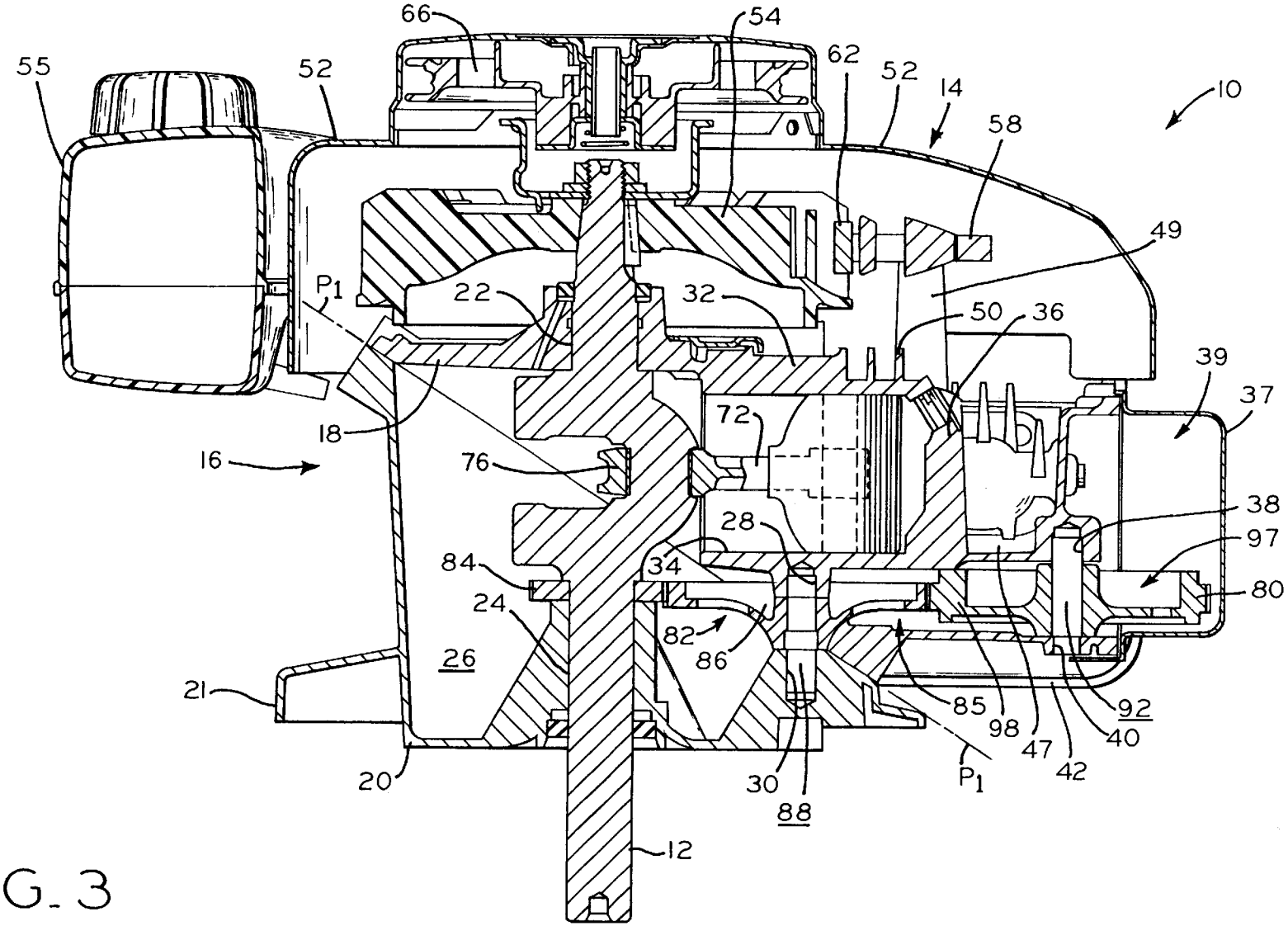
FIG. 3 is a sectional view taken along the crankshaft, showing the crankshaft, drive gear, intermediate gear, and internally profiled cam gear.

Referring to FIGS. 1–5, overhead cam engine 10 is shown, oriented such that crankshaft 12 is disposed vertically for a vertical shaft application. However, engine 10 may also be oriented such that crankshaft 12 is disposed horizontally for a horizontal shaft application. Referring to FIG. 3, engine assembly 14 includes crankcase 16, which is split along plane $P_1$—$P_1$, forming an acute angle to crankshaft 12 such that opposite ends of crankshaft 12 are journalled in full bearings, with upper crankshaft bearing 22 carried by cylinder casing 18 and lower crankshaft bearing 24 carried by mounting flange casing 20.

Figure 4:
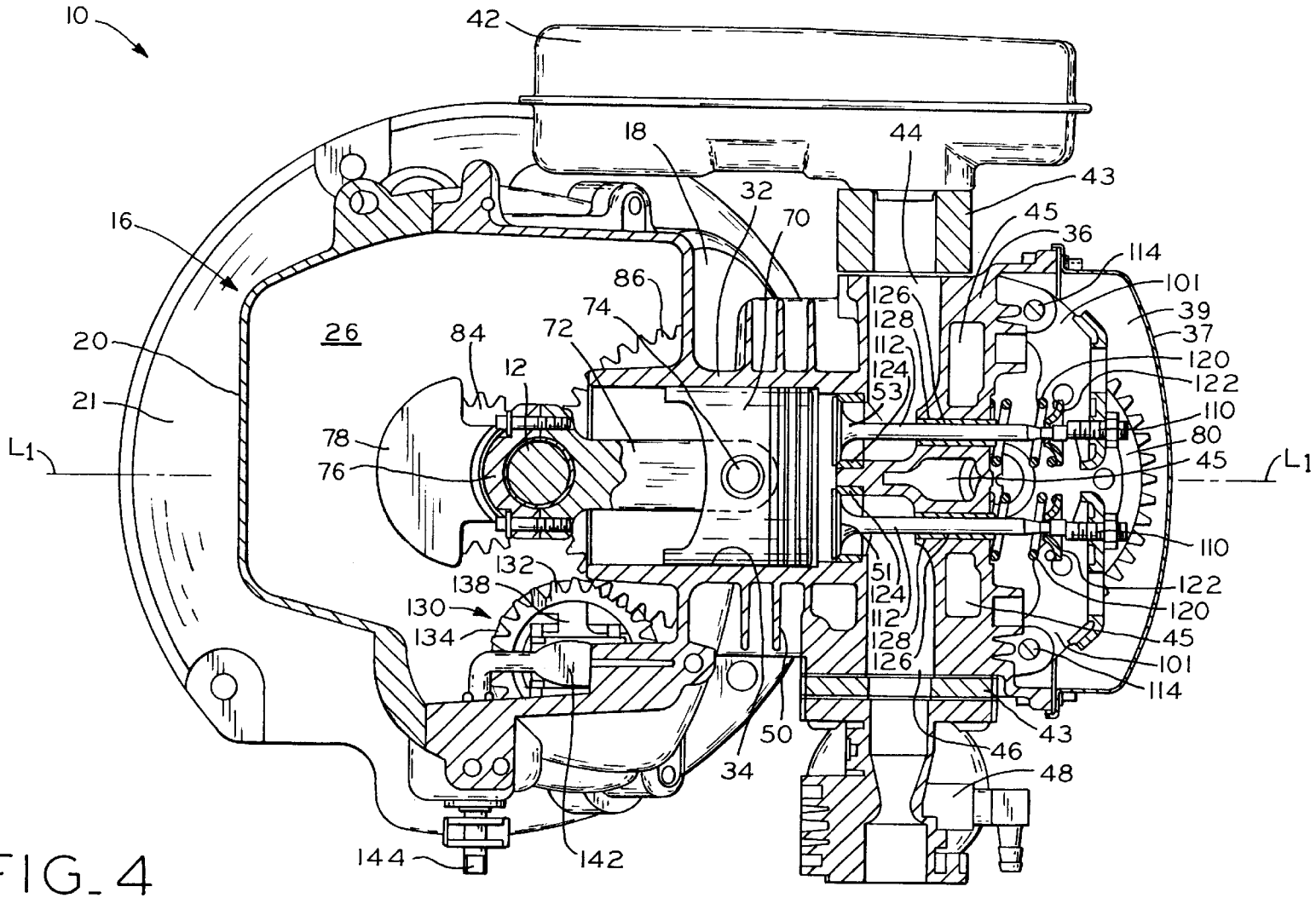
FIG. 4 is a sectional view taken along a plane perpendicular to the crankshaft.

Mounting flange casing 20 includes lower crankshaft bearing 24, oil sump 26 and lower intermediate shaft bearing 30. Mounting flange casing 20 also includes integral mounting flange 21, which may be mounted to a lawnmower deck, for example, in a conventional manner. Cylinder casing 18 includes upper crankshaft bearing 22, cylinder block 32 having cylinder bore 34 therein, upper intermediate shaft bearing 28, and an integral cylinder head 36 adjacent cylinder block 32, having gear pocket 85, and upper and lower camshaft bearings 38, 40. As shown in FIGS. 3 and 4, rocker box cover 37 covers cylinder head 36, and together with cylinder head 36 defines rocker box 39.

Referring to FIGS. 1–2 and 4, muffler 42 is attached to exhaust port 44, and carburetor 48 is attached to intake port 46. As shown in FIG. 4, intake port 46 and exhaust port 44 extend inwardly in cylinder head 36 on opposite sides of cylinder head 36 in a cross flow orientation, which allows the runner length of intake port 46 and exhaust port 44 to be minimized, and also allows muffler 42 and carburetor 48 to be mounted to opposite sides of cylinder head 36. Cylinder block 32 and cylinder head 36 include integral cooling fins 50.

Figure 11:
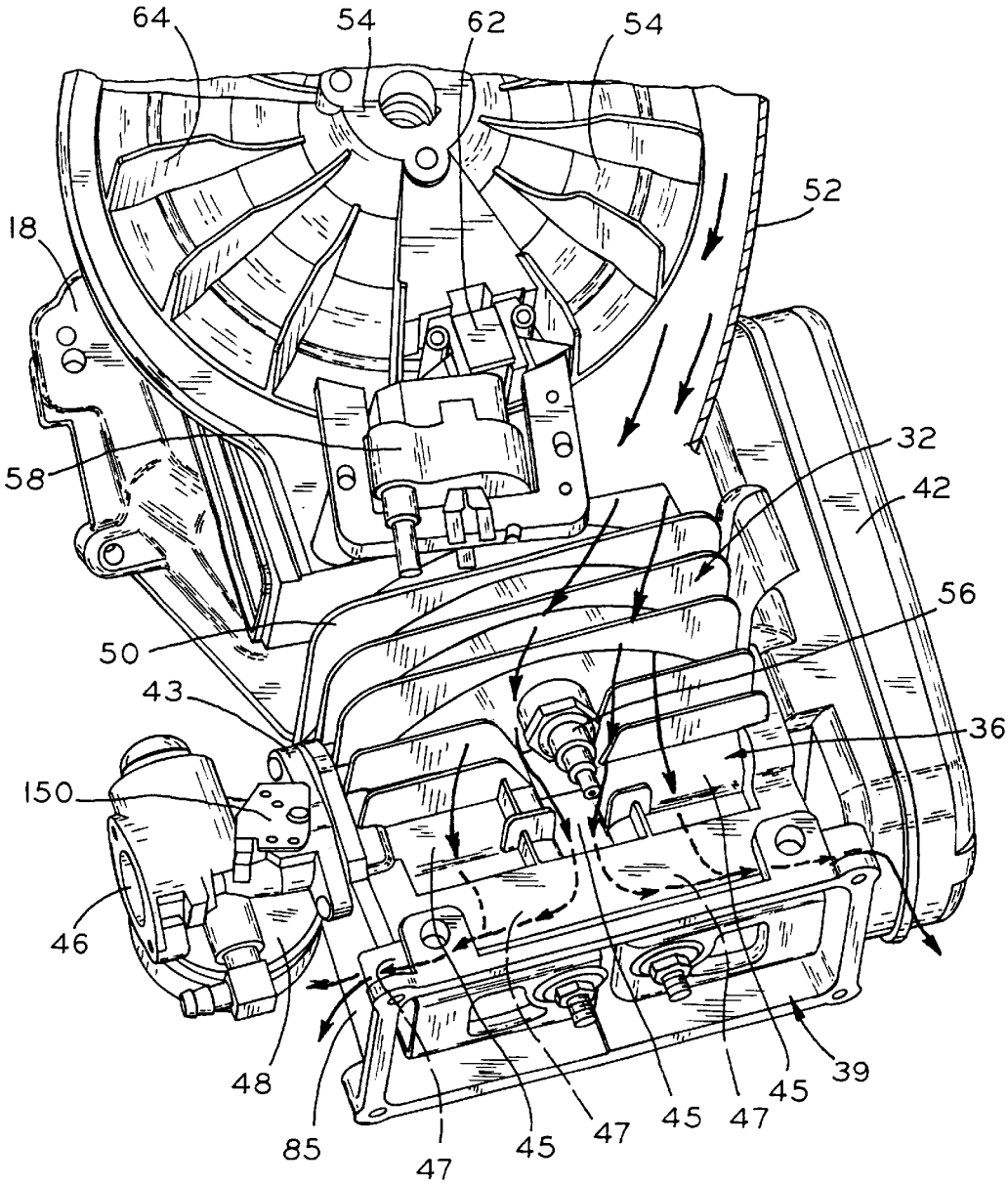
FIG. 11 is an isometric view of the engine of FIGS. 1–4, showing schematically the paths of cooling air from the flywheel.

As shown in FIG. 4, cylinder head 36 further includes three air passageways 45 therethrough, one disposed between valve stems 112 and the others on either side of valve stems 112. As may be seen in FIG. 3, a lateral air passageway 47 extends through cylinder block 32 between cylinder head 36 and gear pocket 85 and communicates with passageways 45. Referring to FIG. 11, it may be seen that blower housing 52 directs cooling air from flywheel 54 around spark plug 56 and into contact with cylinder head 36 at a portion thereof around intake and exhaust valves 51, 53, which are disposed in a plane parallel with piston axis $L_1$—$L_1$, as shown in FIG. 4. Referring again to FIG. 11, the cooling air then passes through passageways 45, contacts gear pocket 85, and then laterally exits cylinder block 32 through either side of lateral passageway 47 near muffler 42 and carburetor 48. As the cooling air exits cylinder block 32, it cools rocker box 39, reducing the amount of coking and burnt oil inside rocker box 39, which in turn lowers the temperature of the oil within oil sump 26, to which the oil returns from rocker box 39, as described below. As shown in FIG. 4, spacers 43, disposed between cylinder head 36 and each of muffler 42 and carburetor 48, allow cooling air to pass therebetween upon exiting lateral passageway 47.

Figure 6:
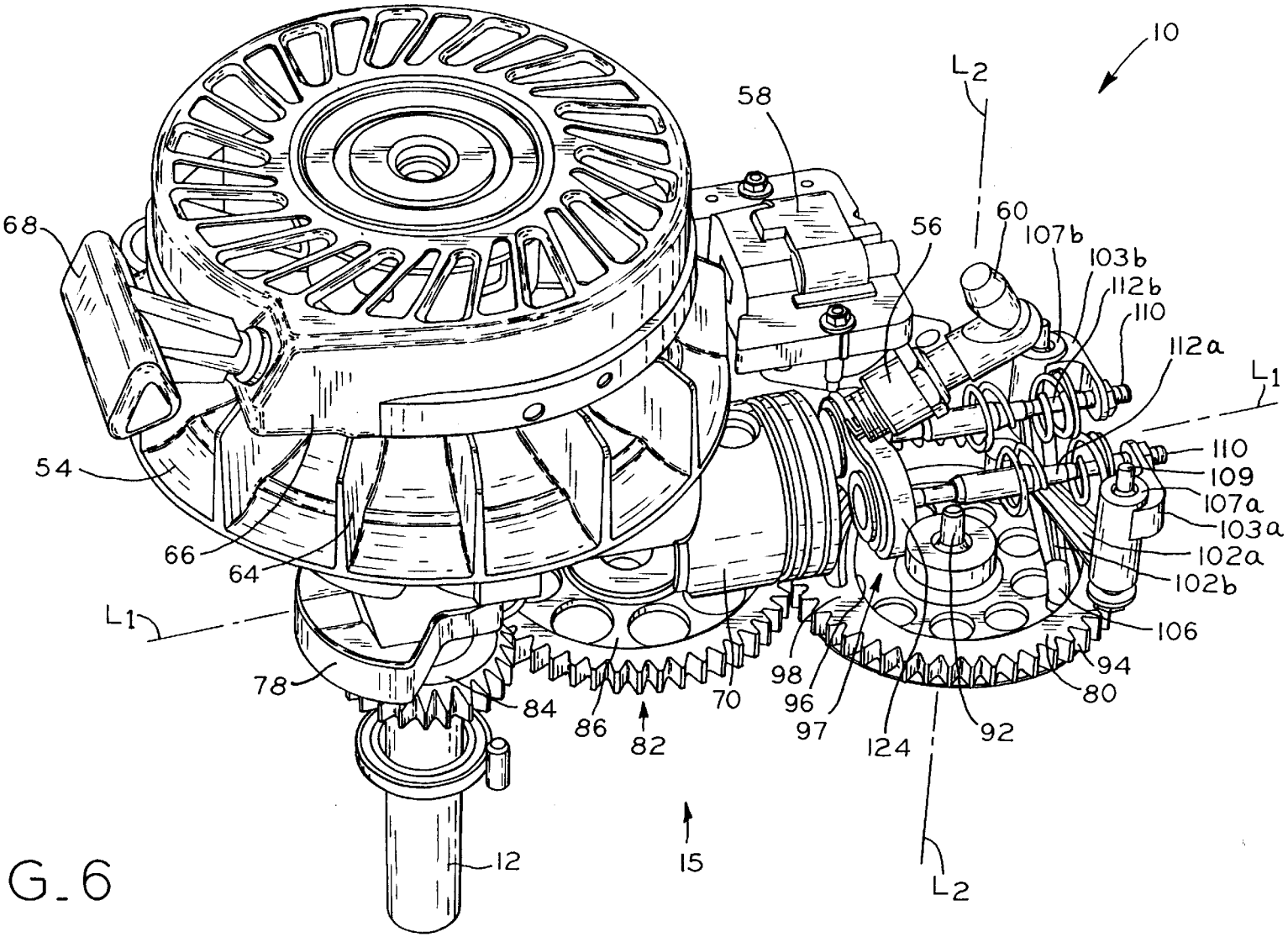
FIG. 6 is a perspective view of part of an overhead cam engine, showing the electronic ignition assembly, recoil starter, and flywheel, as well as the drive train in accordance with a second embodiment.

Referring to FIGS. 1–3 and 6, an electronic ignition assembly includes electronic ignition module 58 attached to supports 49 extending from cylinder block 32. Electronic ignition module 58 is connected to spark plug cap 60 enclosing spark plug 56 by a lead (not shown). Flywheel 54 is secured to one end of crankshaft 12 in a conventional manner, and includes permanent magnet 62 disposed between a pair of flywheel fins 64. Counterweight 63 may be cast or otherwise mechanically retained in a conventional manner. As shown in FIGS. 3 and 6, recoil starter 66 with pull handle 68 is connected to blower housing 52 and is also operatively secured to one end of crankshaft 12 in a conventional manner. As shown in FIG. 3, fuel tank 55 is connected to blower housing 52 in a conventional manner.

Referring to FIGS. 3 and 4, piston 70 is slidably received in cylinder bore 34 within cylinder block 32 and reciprocates along an axis $L_1$—$L_1$. Piston 70 is rotatably connected to connecting rod 72 by wrist pin 74. Connecting rod 72 is also operably connected to crankshaft 12 by a split cap 76 between throws 78. As shown in FIGS. 3–4 and 6–8, crankshaft 12 drives cam gear 80 at half the speed of crankshaft 12 through drive linkage 82. Drive linkage 82 includes drive gear 84 mounted on crankshaft 12 and intermediate gear 86 driven by drive gear 84, which in turn drives cam gear 80 in a timed driven relationship with crankshaft 12. Intermediate gear 86 and cam gear 80 are located within gear pocket 85, which is integral with cylinder block 32 and head 36.

As shown in FIGS. 3–4 and 6–10, intermediate gear 86 is sized such as to engage drive gear 84 and cam gear 80 resulting in a 2:1 reduction of the speed of rotation of crankshaft 12 as seen by cam gear 80. Intermediate gear 86 is rotatably supported on intermediate shaft 88 (FIG. 3) carried in upper and lower intermediate shaft bearings 28, 30. Alternatively, intermediate shaft 88 may be a stationary stub shaft formed integral with cylinder casing 18 or mounting flange casing 20.

As shown in FIG. 4, intermediate gear 86 drives a combination oil pump and governor assembly 130, including governor/pump gear 132 driven by intermediate gear 86. Governor/pump gear includes an inner rotor (not shown) which engages an outer rotor (not shown) disposed within oil pump housing 134. The inner rotor operatively engages the outer rotor to draw oil from oil sump 26 and to pump the oil to various locations in engine 10, including cylinder head 36, via oil passageways (not shown). The oil upon condensation may drain under gravity from cylinder head 36 back into oil sump 26 through gear pocket 85.

Governor weights 138 are rotatably mounted within governor/pump gear 132 on pins (not shown). A spool (not shown) reciprocates on a spindle (not shown) on governor/pump gear 132, and is supported by governor weights 138. When governor/pump gear 132 is driven above a predetermined speed, governor weights 138 swing outwardly under centrifugal force, pushing the spool outwardly to rotate governor arm 142 and governor shaft 144. As shown in FIG. 2, governor shaft is connected to carburetor 48 through linkage including governor lever 146 and governor link 148, such that rotation of governor shaft 144 actuates throttle lever 150 on carburetor 48 to slow the speed of engine 10.

Figure 7:
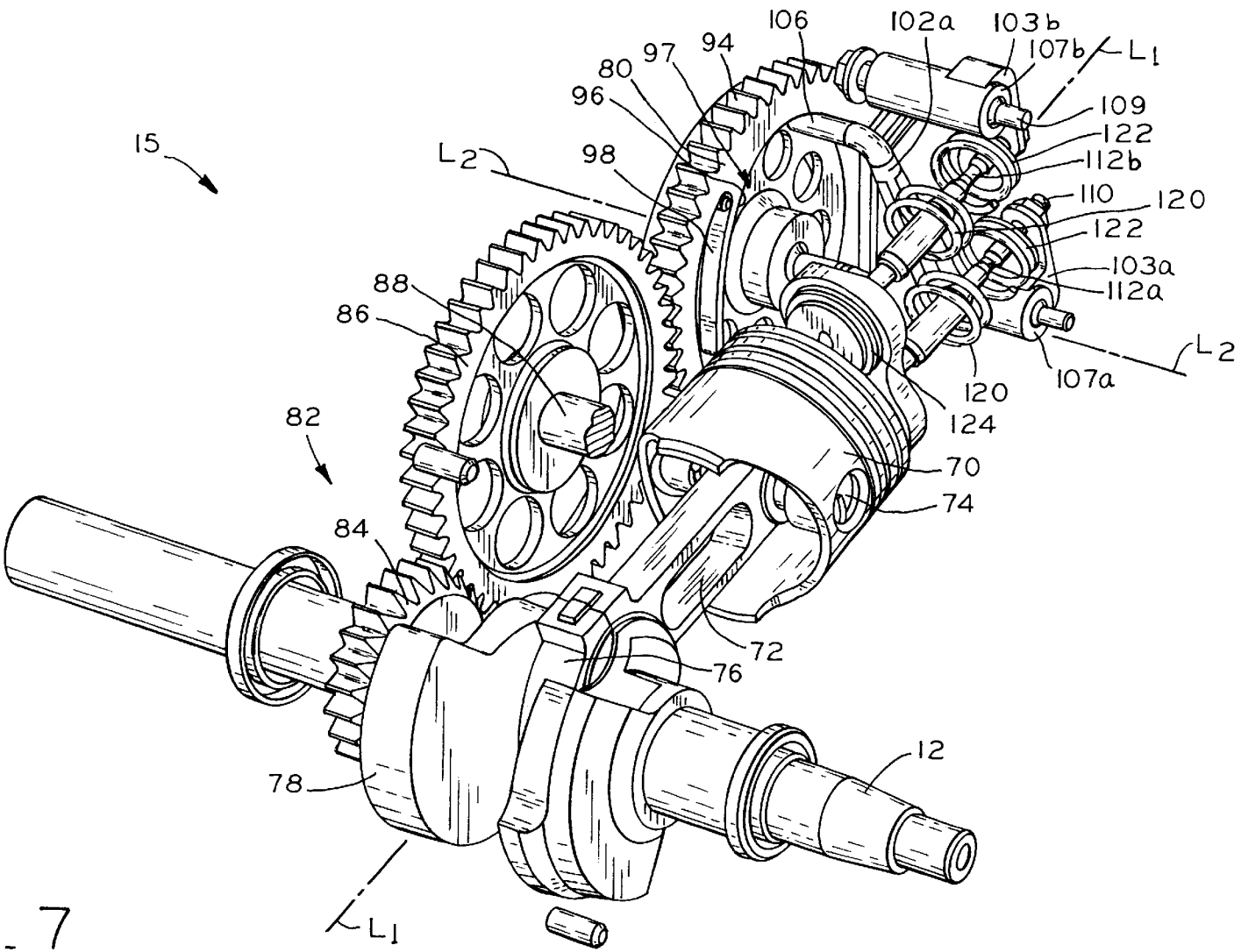
FIG. 7 is a perspective view of the drive train of FIG. 6, showing the crankshaft, drive gear, intermediate gear, internally profiled cam gear, rocker arm shafts and rocker arms.
Figure 8:
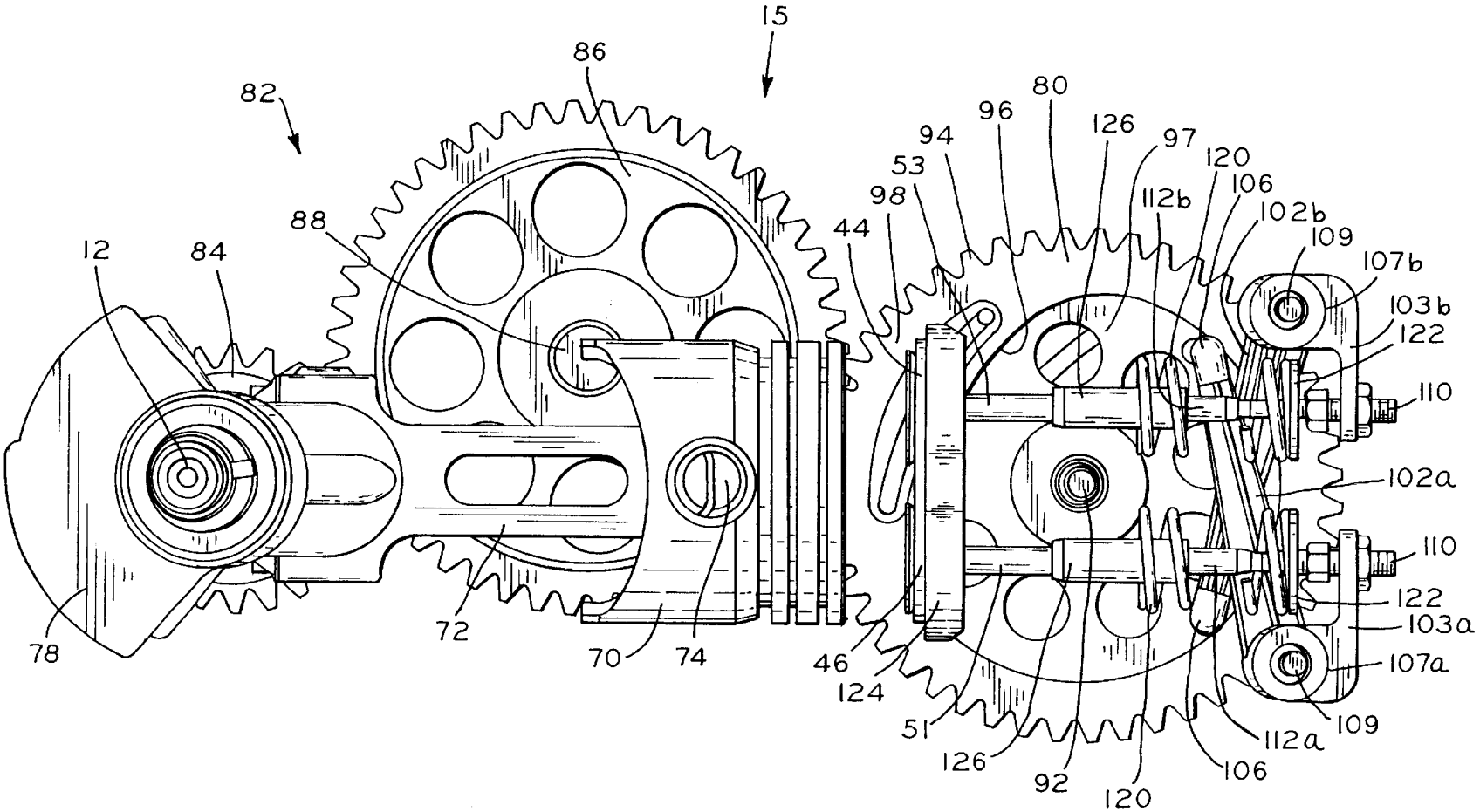
FIG. 8 is a top view of the drive train of FIG. 6.

As shown in FIGS. 3–4 and 6–10, intermediate gear 86 is sized such as to engage cam gear 80, and drives cam gear 80 at half speed of crankshaft 12. As shown in FIG. 4, drive gear 84, intermediate gear 86, and cam gear 80 are disposed in line, such that their centers lie along axis $L_1$—$L_1$. Alternatively, as shown in FIGS. 6–8, intermediate gear 86 may be spaced laterally away from axis $L_1$—$L_1$, to allow or accommodate various shapes and sizes of engine block 14. Drive gear 84, intermediate gear 86, and cam gear 80 may be formed of powder metal, injection molded plastic, or cast metal, for example.

As shown in FIG. 3, cam gear 80 is mounted on short shaft 92 carried in upper and lower camshaft bearings 38, 40 journalled in cylinder head 36. Cam gear 80 rotates on an axis $L_2$—$L_2$ (FIG. 6) perpendicular to axis $L_1$—$L_1$. Alternatively, cam gear 80 may be rotatably journalled on stationary mounting shaft integral with cylinder head 36, which may be formed as a stub shaft.

Cam gear 80 has integrally formed teeth 94 around an outer periphery thereof, and an internal cam profile surface 96 around an inner periphery of interior recess 97 of cam gear 80. As illustrated in FIGS. 6–8, cam profile surface 96 includes thickened portion 98. Cam follower arms 100 (shown in FIG. 5) as well as 102*a* and 102*b* (shown in FIGS. 6–8) terminate in ends or rollers 106 carried in roller bearings 108, which engage cam profile surface 96.

Figure 9:
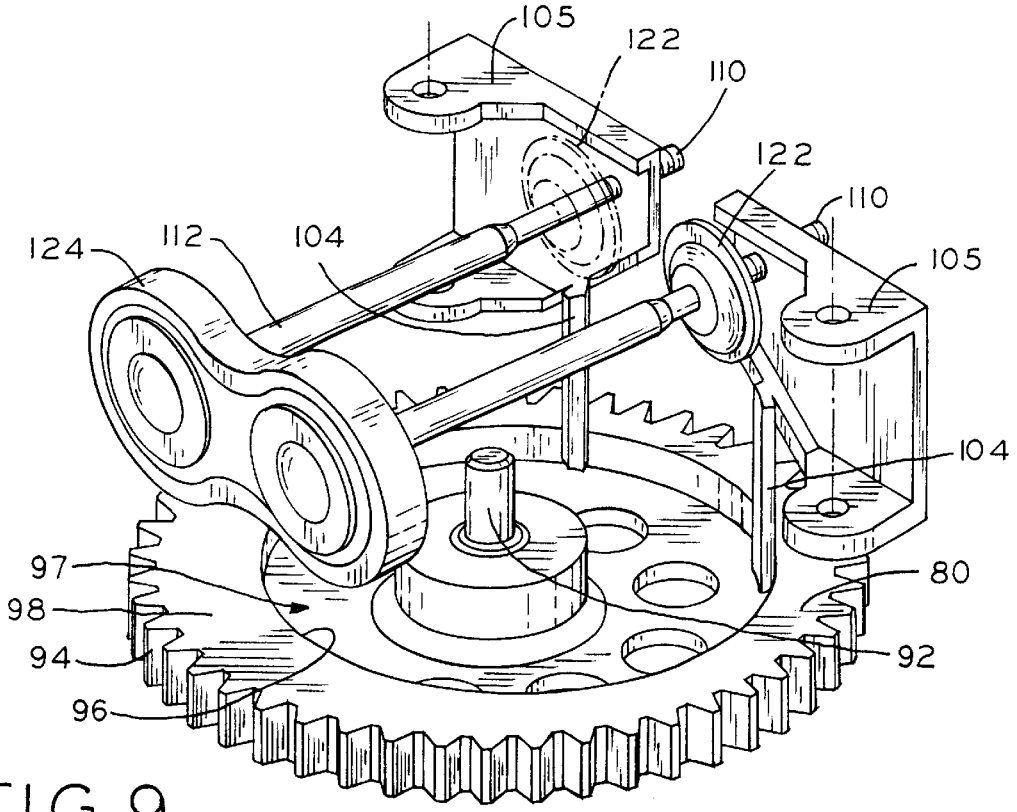
FIG. 9 is a fragmentary perspective view of a third embodiment, showing the internally profiled cam gear, valve stems, and rocker arms.
Figure 10:
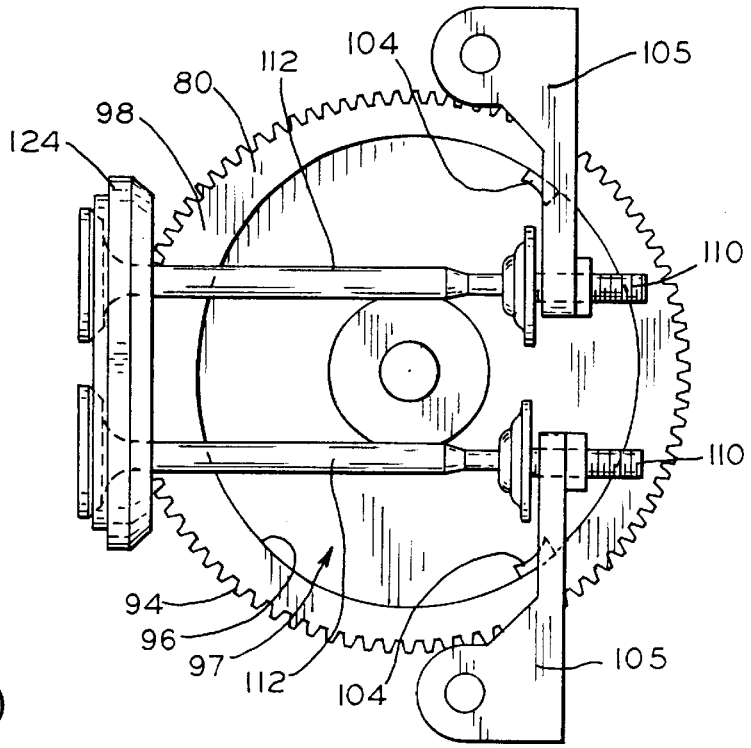
FIG. 10 is a partial top view of the embodiment of FIG. 9, viewed down the mounting shaft of the internally profiled cam gear.

As shown in FIGS. 1–2, 4 and 6–10, cam follower arms 100, 102*a* and 102*b*, and 104 of the first, second and third embodiments, respectively, engage cam profile surface 96 at respective locations near a side of cam gear 80 which is located substantially opposite the location at which cam gear 80 engages intermediate gear 86, and, as may be seen in FIGS. 4, 8, and 10, cam gear 80 does not extend substantially further than the ends of valve stems 112*a*, 112*b*. Alternatively stated, cam follower arms 100, 102*a* and 102*b*, and 104 engage cam profile surface 96 at respective locations each spaced a maximum distance from crankshaft 12. In addition, cam gear 80 is disposed closely adjacent cam follower arms 100, 102*a* and 102*b*, and 104 and additionally, rollers 106 extend into interior recess 97 of cam gear 80. Advantageously, this arrangement reduces the length of drive train 15, and in turn the length of engine 10.

Figure 5:
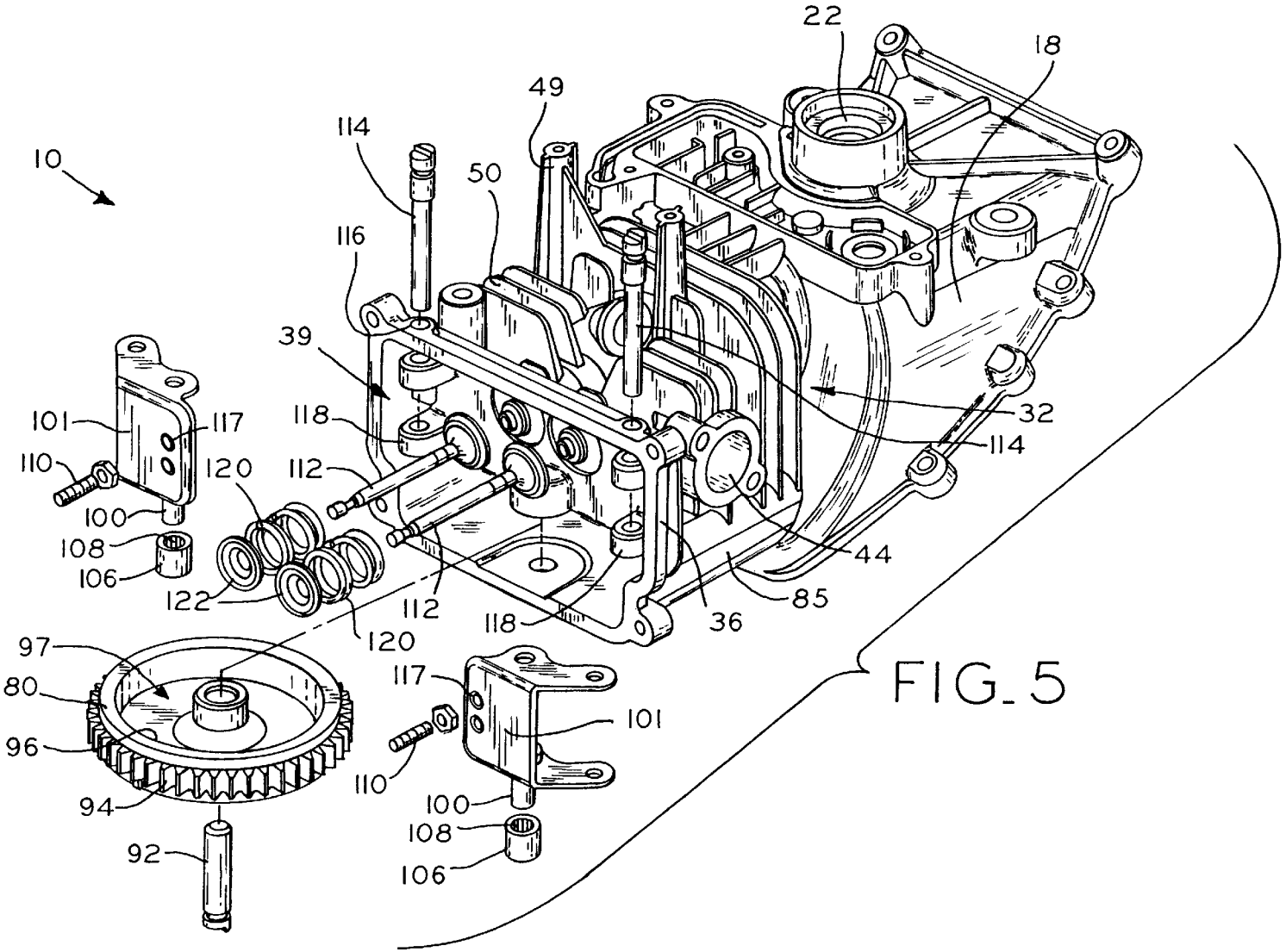
FIG. 5 is an isometric exploded view of part of the engine of FIGS. 1–4.

In the first embodiment shown in FIGS. 4–5, rocker arms 101 are pivotally mounted to rocker arm shafts 114 for rotation about a pair of axes perpendicular to axis $L_1$—$L_1$. Rocker arm shafts 114 are received in apertures 116 in cylinder head 36 and rotatably carried in bosses 118 integral with cylinder head 36. Lash adjusting screws 110 are fixed within apertures 117 in rocker arms 101 and abut valve stems 112. Valve springs 120 are coiled about valve stems 112 under compression between cylinder head 36 and valve keepers 122, and bias valves 51, 53 against valve seats 124. Cam follower arms 100 are fixed in rocker arms 101, and extend from rocker arms 101 perpendicular to cam gear 80. Rollers 106 are rotatably snap-fit or attached in a conventional manner on the ends of cam follower arms 100 supported by roller bearings 108, and engage cam profile surface 96 of cam gear 80 to rotate rocker arms 101 and open intake and exhaust valves 51, 53.

The operation of engine 10 will be explained with primary reference to the second embodiment as shown in FIGS. 6–8, however, it should be understood that the first embodiment shown in FIGS. 1–5 and the second embodiment in FIGS. 9–10 operate in a similar manner. In the second embodiment shown in FIGS. 6–8, and most clearly in FIG. 8, cam follower arms 102*a* and 102*b* are disposed in an overlapping crosswise arrangement generally parallel to cam gear 80. As cam gear 80 is driven, the thickened portion 98 of cam profile surface 96 periodically rocks cam follower arms 102*a* and 102*b*, causing cam follower arms 102*a* and 102*b* to rotate with rocker arm shafts 107*a* and 107*b*. Rocker arm shafts 107*a* and 107*b* are mounted to cylinder head 36 for rotation about a pair of axes perpendicular to axis $L_1$—$L_1$ on respective shaft portions 109.

Rocker arms 103*a* and 103*b* are rigidly connected to rocker arm shafts 107*a*, 107*b*, and engage valve stems 112*a*, 112*b* in a conventional manner. Referring to FIG. 4, valve stems 112*a*, 112*b* are supported within valve guides 126 disposed within valve guide bores 128 in cylinder head 36 substantially parallel to axis $L_1$—$L_1$. Valves stems 112*a* and 112*b* seat against valve seats 124 which may be press-fitted or cast into the open ends of intake and exhaust ports 46, 44. Referring again to FIGS. 6–8, valve springs 120, comprising coil springs around valve stems 112*a* and 112*b*, are mounted under compression and bias valves 51, 53 against valve seats 124, causing the intake and exhaust valves 51, 53 to be closed when rocker arms 103*a*, 103*b* are not actuated.

As shown in FIGS. 6–8, piston 70 is in a top dead center position, and valve stems 112*a*, 112*b* are shown abutting valve seats 124 such that intake port 46 and exhaust port 44 are closed. Drive train 15 operates on a conventional four-stroke cycle, including the steps of intake, compression, power and exhaust. As piston 70 reciprocates, crankshaft 12 and drive gear 84 are rotated, driving cam gear 80 at half speed through intermediate gear 86.

Referring to FIG. 8, on the intake stroke, cam profile surface 96 of cam gear 80 rotates cam follower arm 102*a*, rocker arm shaft 107*a* and rocker arm 103*a*. The rotation of rocker arm 103*a* pushes valve stem 112*a* and opens intake valve 51 allowing a fuel/air mixture from a carburetor into combustion chamber 71 (shown in FIG. 4) through intake port 46. On the compression and power strokes, cam follower arms 102*a*, 102*b* are not rotated by cam profile surface 96 of cam gear 80 and valve springs 120 bias rocker arms 103*a*, 103*b* such that intake and exhaust valves 51, 53 are closed. On the power stroke, cam profile surface 96 of cam gear 80 rotates cam follower arm 102*b*, rocker arm shaft 107*b* and rocker arm 103*b*. The rotation of rocker arm 103*b* pushes valve stem 112*b* and opens exhaust valve 53, venting exhaust gas out of combustion chamber 71 through exhaust port 44.

Referring to FIGS. 9 and 10, a third embodiment of the present invention is shown. Cam follower arms 104 extend from rocker arms 105 in a perpendicular relationship to cam gear 80, and engage the cam profile surface 96 of cam gear 80. Cam follower arms 104 are rigidly attached to a pair of rocker arms 105, which are connected to a pair of valve stems 112, and rocker arms 105 may be rotatably mounted to the engine block in the same manner as in the first embodiment shown in FIGS. 1–5. As cam gear 80 is driven, cam profile surface 96 of cam gear 80 periodically presses cam follower arms 104 radially inwardly causing rocker arms 80 to rotate. In the first embodiment shown in FIGS. 1–5 and the second embodiment shown in FIGS. 9 and 10, the rotation of rocker arms 101 or 105, respectively, actuates the intake and exhaust valves in the opposite manner as in the second embodiment.

While the present invention has been described as having preferred designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. An overhead cam engine, comprising:

a crankshaft, connecting rod, and piston assembly, said piston reciprocating within a cylinder block connected to a cylinder head;

a cam gear driven by said crankshaft and rotatably supported in said cylinder head, said cam gear having gear teeth around an outer periphery thereof and a cam profile surface disposed around an inner periphery thereof;

drive linkage between said crankshaft and said cam gear; and a pair of rocker arms rotatably mounted in said cylinder block for actuating a pair of valves, each said rocker arm including a cam follower in engagement with said cam profile surface.

2. The engine of claim 1, wherein said piston reciprocates along a first axis, and said cam gear is mounted for rotation about a second axis perpendicular to said first axis.

3. The engine of claim 1, wherein said drive linkage comprises:

a drive gear mounted on said crankshaft; and an intermediate gear intermeshing with said drive gear and said internally profiled cam gear.

4. The engine of claim 3, wherein said intermediate gear is sized such as to engage said drive gear and said cam gear, resulting in a 2:1 speed reduction between said crankshaft and said cam gear.

5. The engine of claim 1, wherein said cam followers engage said cam profile surface at respective locations each spaced a maximum distance from said crankshaft.

6. The engine of claim 5, wherein said cam followers comprise cam follower arms extending from said rocker arms, said cam gear disposed closely adjacent said cam follower arms.

7. The engine of claim 6, in which said cam follower arms are disposed in an overlapping crosswise relationship.

8. The engine of claim 7, wherein said cam follower arms are substantially parallel to a laterally inner face of said cam gear, said cam follower arms terminating in rollers which engage said cam profile surface.

9. The engine of claim 6, wherein said cam followers comprise cam follower arms extending from said rocker arms perpendicular to said cam gear.

10. The engine of claim 9, wherein said cam follower arms terminate in ends which engage said cam profile surface.

11. The engine of claim 3, wherein said intermediate gear drives an oil pump and governor.

12. An overhead cam engine, comprising:

a crankshaft driven by a piston and connecting rod assembly, said piston reciprocating in a cylinder block connected to a cylinder head;

a drive gear mounted to said crankshaft;

an intermediate gear driven by said drive gear;

a cam gear driven by said intermediate gear, said cam gear rotatably supported in said cylinder head and disposed adjacent a side of said head, said cam gear having gear teeth around an outer periphery thereof and a cam profile surface disposed around an inner periphery thereof; and a pair of rocker arms rotatably mounted in said cylinder head for actuating a pair of valves, said rocker arms each including a cam follower in engagement with said cam profile surface.

13. The engine of claim 12, wherein said cam followers comprise cam follower arms extending from said rocker arms in an overlapping crosswise relationship, said cam follower arms terminating in rollers engaging said cam profile surface.

14. The engine of claim 13, wherein said cam gear is disposed closely adjacent said cam follower arms, said cam follower arms parallel to said cam gear.

15. The engine of claim 12, wherein said cam followers comprise cam follower arms extending from said rocker arms perpendicular to said cam gear and engaging said internal cam profile surface.

16. The engine of claim 12, wherein said intermediate gear is sized such as to engage drive gear and said cam gear, resulting in a 2:1 speed reduction between said crankshaft and said cam gear.

17. An overhead cam engine, comprising:

a crankshaft driven by a piston and connecting rod assembly, said piston reciprocating in a cylinder block adjacent a cylinder head;

a cam gear mounted for rotation in said cylinder head in a timed driven relationship with said crankshaft, said cam gear having gear teeth around an outer periphery thereof and a cam profile surface around an inner periphery thereof;

a pair of rocker arms rotatably mounted in said cylinder head, said rocker arms actuating intake and exhaust valves in said cylinder head; and a cam follower arm extending from each of said rocker arms, said cam follower arms disposed perpendicular to said cam gear and engaging said cam profile surface.

18. The engine of claim 17, further comprising:

a drive gear mounted on said crankshaft; and an intermediate gear engaging said drive gear and said cam gear, resulting in a 2:1 speed reduction between said crankshaft and said cam gear.

19. The engine of claim 17, wherein said cam gear is disposed closely adjacent said cam follower arms, and said cam follower arms each engage said cam profile surface at respective locations each spaced a maximum distance from said crankshaft.

20. The engine of claim 19, wherein said cam follower arms terminate in rollers for engaging said cam profile surface.

* * * * *